US006154888A

United States Patent [19]

Krohn

[11] Patent Number: 6,154,888

[45] Date of Patent: Dec. 5, 2000

[54] STETHOSCOPE POCKET

[75] Inventor: Connie Jean Krohn, 13091 N. County Rd. 125 West, Tennyson, Ind. 47637

[73] Assignee: Connie Jean Krohn, Tennyson, Ind.

[21] Appl. No.: 09/376,136

[22] Filed: Aug. 17, 1999

[51] Int. Cl.[7] ..... A41D 27/20

[52] U.S. Cl. ..... 2/250; 2/94

[58] Field of Search ..... 2/250, 23, 247, 2/227, 114, 94, 253, 51

[56] References Cited

U.S. PATENT DOCUMENTS

| | | | |
|---|---|---|---|
| 1,460,434 | 1/1923 | Newberry | 2/250 |
| 1,466,330 | 8/1923 | Cindel | 2/250 |
| 2,472,286 | 6/1949 | Drasnin | 2/247 |
| 3,968,522 | 7/1976 | Reiss | 2/250 |
| 4,613,991 | 9/1986 | Grover | 2/23 |
| 4,637,075 | 1/1987 | Ingrisano et al. | 2/94 |
| 4,791,681 | 12/1988 | Dean | 2/106 |
| 5,072,456 | 12/1991 | Elin | 2/94 |
| 5,517,696 | 5/1996 | Krugler | 2/250 |
| 5,884,338 | 3/1999 | Golde | 2/247 |

*Primary Examiner*—John J. Calvert
*Assistant Examiner*—Alissa L. Hoey

[57] ABSTRACT

A pocket added to a scrub pant that is suitable for carrying an unfolded stethoscope. The outline of the pocket approximates, and is larger than, the shape of the unfolded stethoscope. The pocket totally encloses the stethoscope. The pocket provides a convenient, safe and sanitary place for a stethoscope.

2 Claims, 2 Drawing Sheets

STETHOSCOPE POCKET

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

Not applicable

BACKGROUND OF THE INVENTION

1. Field of the Invention

This invention relates to a modification of a garment comprising an addition of a pocket convenient for carrying an unfolded stethoscope.

2. Background Information

A stethoscope is an instrument, used by medical professionals, in auscultation to convey sounds in a chest or other parts of a body to an ear of an examiner.

Current practice is for a person with a stethoscope to hook it around his or her neck, or drape it over his or her shoulders, or fold it and stuff it in a conventional pocket. These are inconvenient, unsafe, unsanitary, and not particularly stylish alternatives.

It is desirable to have a convenient way to carry a stethoscope.

As will be shown in the subsequent description of the preferred embodiment of the present invention, these and other shortcomings in the present state of the art are overcome.

SUMMARY OF THE INVENTION

The present invention is a modification to a garment comprising a pocket sized to carry an unfolded stethoscope completely contained in said pocket. In the preferred embodiment of the present invention, the pocket has an outline approximately the shape of said stethoscope, said outline being sufficiently larger than the shape of said stethoscope so as to permit ease of dropping said stethoscope into said pocket and removal of said stethoscope from said pocket. The invention, in the preferred embodiment, has a semi-circular bottom to match a bottom end of said stethoscope, which tends to ride on said bottom when said stethoscope is inserted into said pocket.

DESCRIPTION OF THE PREFERRED EMBODIMENTS

Figure 1:
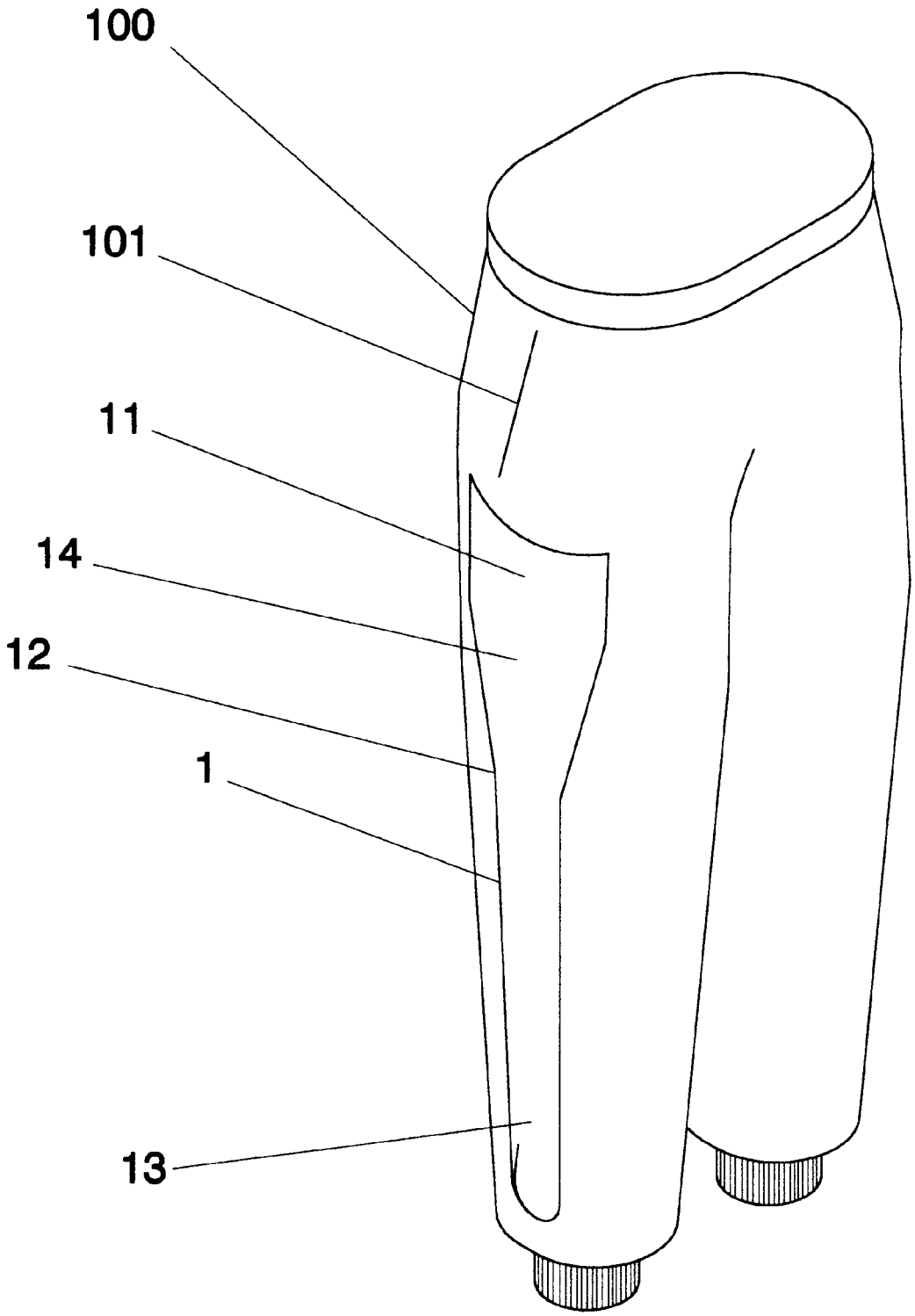
FIG. 1 illustrates the preferred embodiment of the present invention.
Figure 2:
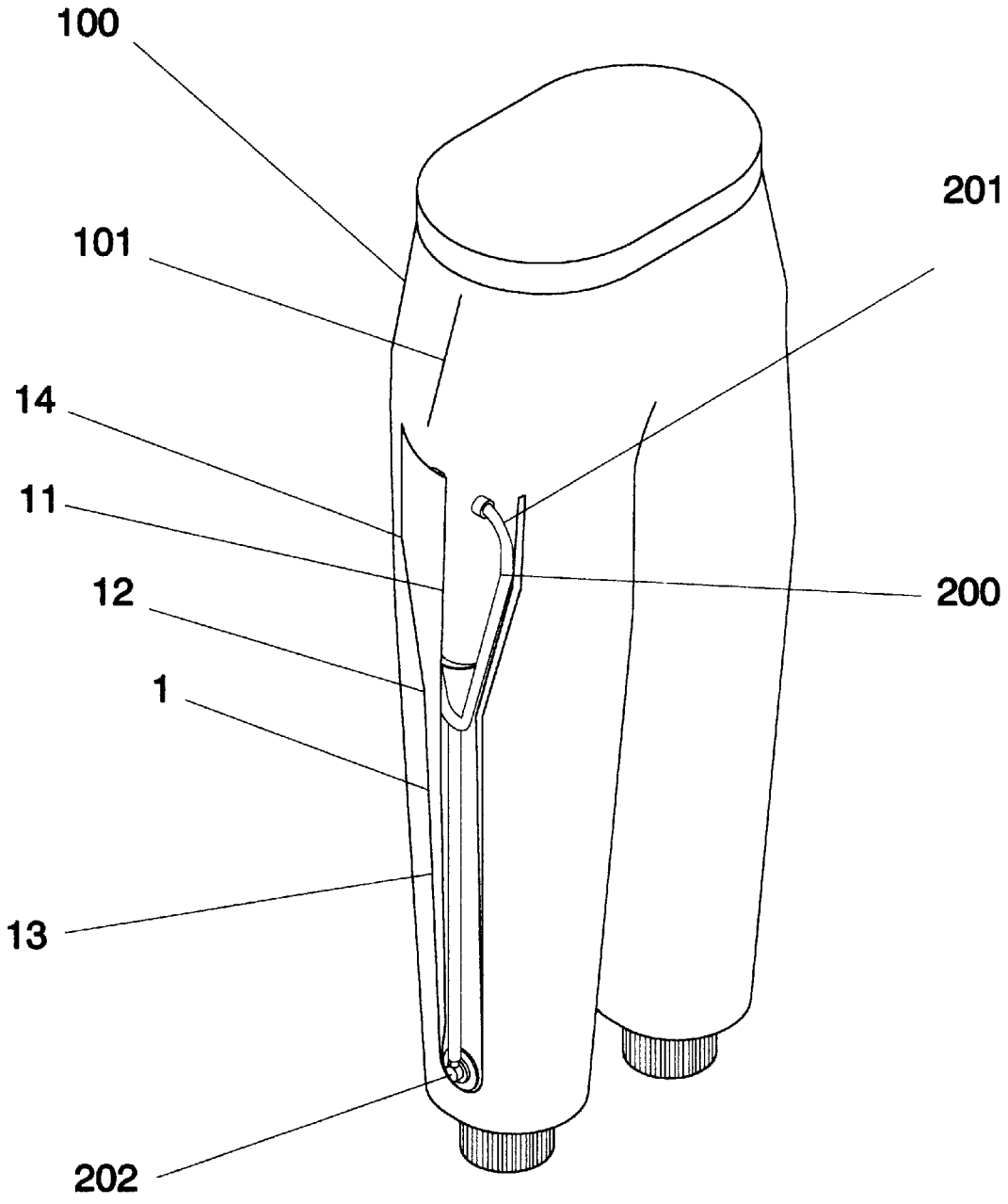
FIG. 2 illustrates a cutaway view of the preferred embodiment of the present invention.

FIGS. 1 and 2 illustrate a preferred embodiment of the present invention, a stethoscope pocket 1 useful in the carry of an well known unfolded stethoscope 200 said stethoscope pocket 1 attached to a scrub pant 100 and forming a pouch 11. For purpose of definition, scrubs are garments used by hospital and medical workers of all genders that typically include shirts and pants. A well known pocket 101 is shown. FIGS. 1 and 2 illustrates a pair of such scrub pants 100. Said stethoscope pocket 1 further comprises a upper portion 14 with tapered sides 12 and a lower portion 13. In the preferred embodiment of the present invention, the pocket 1 has an outline approximating the outer shape of said stethoscope 200, said outline of said pocket 1 sufficiently large as to leave an inch or two of distance from the outer shape of said stethoscope and said pocket 1 outline. Said pocket 1 is sufficiently large so as to completely contain said stethoscope 200 when said stethoscope is dropped into said pocket 1. In practice, in the preferred embodiment of the present invention, said stethoscope 200 has a chest piece 202 which sits on a semi-circular bottom of the pocket 1. The stethoscope 200 tends to center in the pocket 1. The purpose of having the pocket 1 with an outline providing some distance between the pocket 1 and the stethoscope 200 is for ease of dropping said stethoscope 200 into said pocket 1. A purpose in having the pocket 1 large enough to completely contain the stethoscope 200 which further comprises at least one binaural 201 so the at least one binaural 201 does not snag on other objects, such as tables or desks, as said stethoscope 200 is being carried in said pocket 1. A purpose of having said pocket 1 with an outline approximating the shape of the stethoscope 200 is for economy of material usage in constructing said pocket 1.

The preferred material of construction for said stethoscope pocket 1 is typically the same material as is used for the scrub pant 100. This could be a fabric such as cotton, nylon, or a blend of natural and artificial fibers. It could even be paper or plastic.

Although the description above contains many specificities, these should not be construed as limiting the scope of the invention but as merely providing illustrations of some of the presently preferred embodiments of this invention.

Thus the scope of the invention should be determined by the appended claims in the formal application and their legal equivalents, rather than by the examples given.

I claim:

1. A pair of pants for use by medical workers comprising two leg portions and a lower body portion; a pocket attached to one of the leg portions for holding a fully extended stethoscope; Wherein the pocket has two sections, a first, upper section and a second lower section, the first section having a generally trapezoidal shape and the second section having an elongated rectangular shape, the upper section shape for accommodating the binaural end of the stethoscope and the lower section for accommodating the chest piece end of the stethoscope.

2. The pocket of claim 1 wherein said pocket completely encompasses the stethoscope when inserted in the pocket.

* * * * *